US005207605A

United States Patent [19]

Kroeber

[11] Patent Number: 5,207,605

[45] Date of Patent: May 4, 1993

[54] OUTBOARD PROPELLER GUARD

[76] Inventor: Kenneth Kroeber, 157 Flamingo Rd., Edgewater, Fla. 32141

[21] Appl. No.: 847,825

[22] Filed: Mar. 6, 1992

[51] Int. Cl.[5] ..... B63H 5/16

[52] U.S. Cl. ..... 440/71; 440/72

[58] Field of Search ..... 440/49, 66, 71, 72, 440/76, 900

[56] References Cited

U.S. PATENT DOCUMENTS 3,099,240 7/1963 Montague ..... 114/281

5,007,869 4/1991 Zoellner ..... 440/900

*Primary Examiner*—Joseph F. Peters, Jr.

*Assistant Examiner*—Clifford T. Bartz

*Attorney, Agent, or Firm*—McCormick, Paulding & Huber

[57] ABSTRACT

Two angle brackets secure a severely swept plastic wing-like propeller guard to the sides of the motor housing or skeg. The left and right wing-like projections have a horizontal center wing segment oriented parallel the axis of propeller rotation, and upturned outer wing segments that are provided in the plane of propeller rotation.

4 Claims, 2 Drawing Sheets

OUTBOARD PROPELLER GUARD

This invention relates generally to attachments for altering the geometry of the underwater drive portion of an outboard motor, or the outdrive of an inboard/-outboard motor.

More specifically, the present invention provides an improved attachment for the skeg of an outboard motor housing, such that the function of the skeg itself is vastly improved, and in particular so that the danger to marine life from the rotating propeller is substantially reduced.

A general object of the present invention is to provide a guard for at least the lower half of the rotating propeller normally provided on an outboard motor such that the propeller does not tend to strike underwater objects, particularly the manatee, when the motor on the boat to which it is attached is operated in shallow water. Manatees commonly swim just below the surface, and hence are susceptible to injury by the rotating propellers, especially those of outboard motors in the waterways of Florida and other similar geographical locations.

Another advantage of the present invention can be attributed to the fact that the propeller guard to be described also serves to protect the propeller itself from damage due to underwater hazards such as sand bars and other hidden objects located just below the surface of the water. The guard is so designed as to protect the propeller even when the motor is being operated in reverse.

Still another advantage of the propeller guard described herein can be attributed to its hydrofoil action. While it is common knowledge that the hydrofoil provides a smoother and more stable ride, as well as contributing to improved fuel economy, the propeller guard of the present invention also provides protection against cavitation.

The present invention resides in the environment of the lower generally vertically oriented submerged portion of the motor housing which supports the rotating propeller on a generally horizontally oriented axis, and more particularly the present invention provides a guard that is uniquely supported on a depending skeg portion of the outboard motor housing, which skeg is oriented in a vertical plane below and forward of the rotating propeller. The propeller guard of the present invention is adapted to be mounted to the skeg by unique bracket means so as to afford a variety of combinations as between the propeller guard itself and the bracket means to accommodate outboard motors of different manufacturers and of different horse power ratings.

The propeller guard includes left and right-hand wing-like projections extending outwardly from the bracket means, and each wing is swept rearwardly to provide for wing tip portions that are upturned and located in the plane of the rotating propeller.

The prior art is replete with examples of propeller guards which purport to either improve the performance of the boat and motor combination, or which purport to protect the propeller against damage due to striking an underwater object. Zoellner U.S. Pat. No. 5,007,869 illustrates an example of a propeller guard which is mounted on the skeg, and includes a flat semicircular plate oriented at an angle to the axis of the propeller and located well forward of the plane of rotation of the propeller. The present invention seeks to provide a propeller guard located in more closely associated relationship with the plane of rotation to the propeller, and which includes separate bracket and projecting wing portions so as to afford a greater degree of latitude in providing a suitable product for a variety of outboard motor configurations.

Another prior art patent, Montague U.S. Pat. No. 3,099,240, shows a propeller guard which does include upturned wing-like projections, however, in Montague these projections are provided aft the plane of rotation for the propeller, and instead of being mounted to the skeg by bracket means attached to the sides of the skeg Montague relies solely on two fasteners securing a relatively narrow flange secured to the aft edge of the skeg.

DETAILED DESCRIPTION

Figure 1:
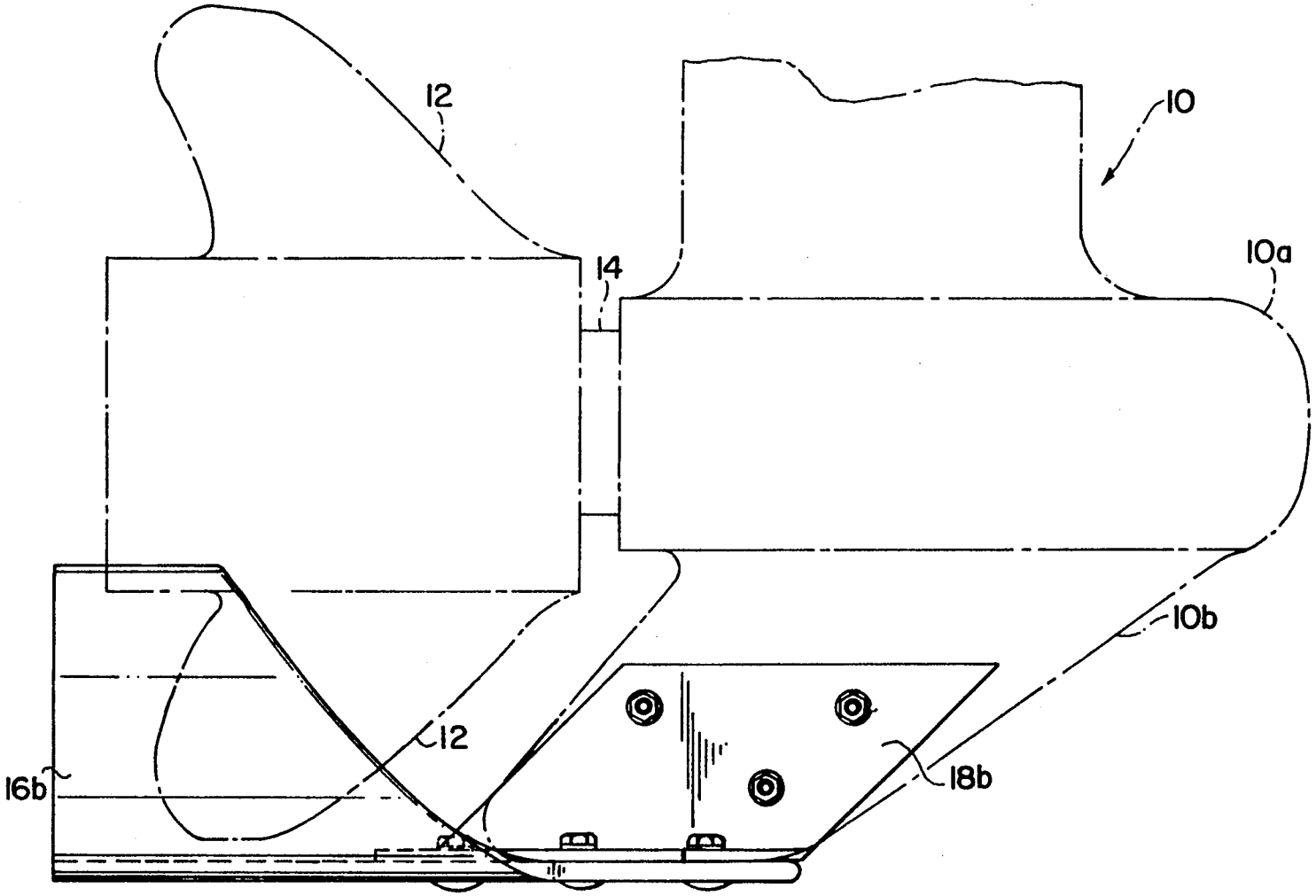
FIG. 1 is a side elevational view showing a typical outboard motor housing with its depending skeg and rotating propeller in phantom lines. A propeller guard incorporating the present invention is shown mounted to the skeg by fasteners.

Turning now to the drawings in greater detail, FIG. 1 shows the lower portion of a generally vertically oriented outboard motor housing in phantom lines at 10. The housing includes a portion 10*a* which houses a right angle change in the direction of the drive shaft from vertical to horizontal. Thus, the housing 10 rotatably receives a generally vertically oriented drive shaft from the cooled motor (not shown) and a propeller 12 is rotatably mounted on a horizontally oriented shaft 14 which is rotated through the above mentioned right angle drive by a vertically oriented engine shaft (not shown).

Figure 2:
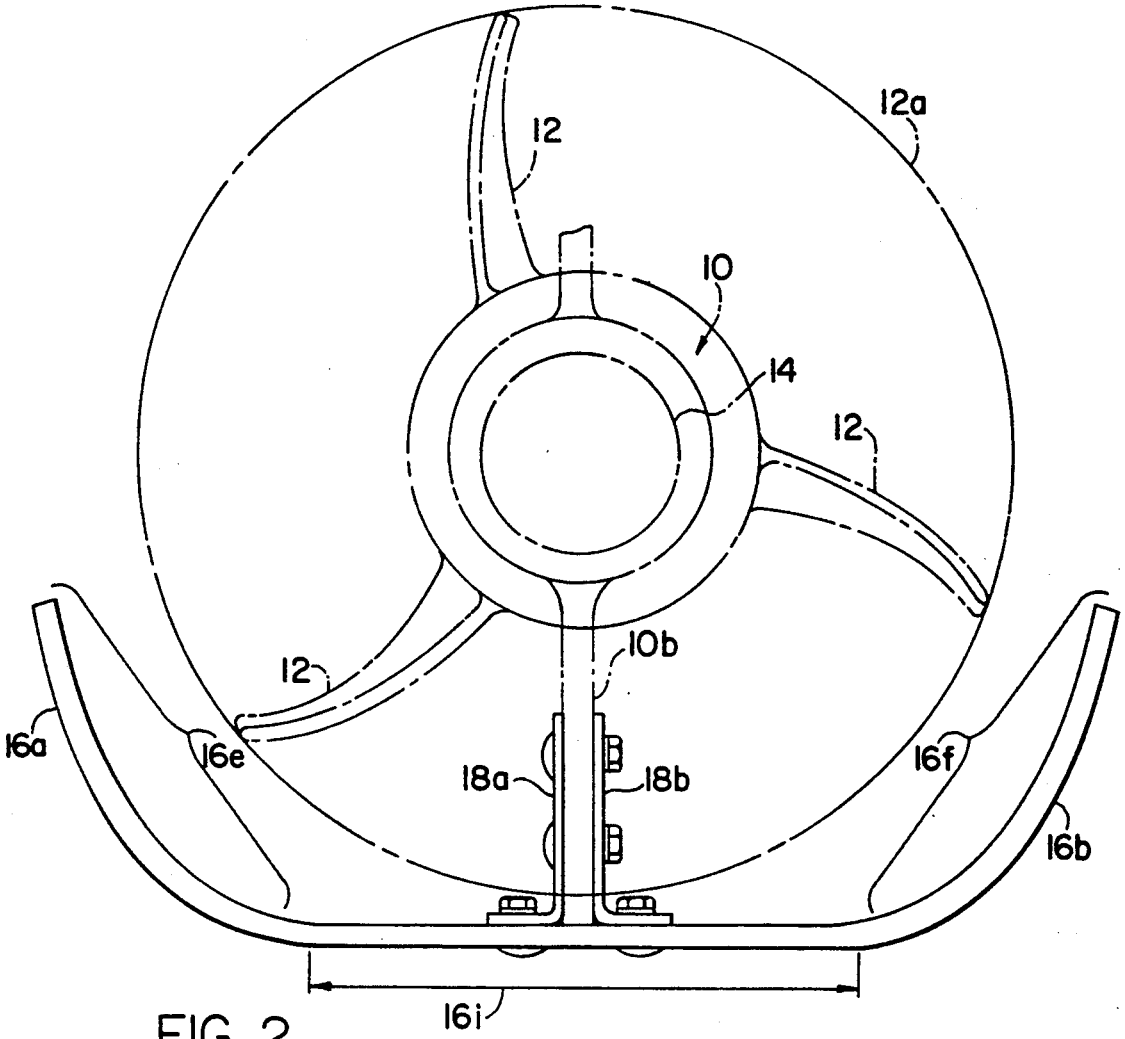
FIG. 2 is a rear end view of the combination depicted in FIG. 1.
Figure 3:
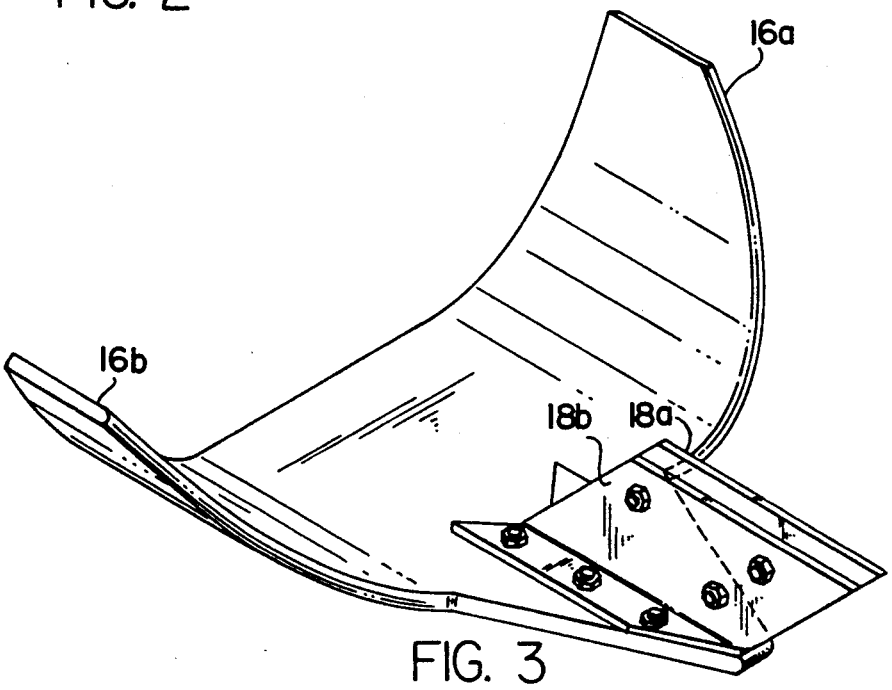
FIG. 3 is a perspective view illustrating the improved propeller guard and associated bracket means for securing the wing portion of the propeller guard to the skeg.

The propeller 12 is of conventional geometry and has at least two and generally three blades as suggested in FIG. 2. Two of the blades are illustrated in outline in FIG. 1 so as to afford a reference for the propeller plane of rotation, at least in the fore and aft direction.

Still with reference to FIG. 2 the circular path defined by the propeller blade tips is suggested generally at 12*a*. This view also shows the skeg portion of the outboard motor housing as suggested generally at 10*b*. As illustrated in FIG. 1 the skeg portion 10*b* will generally be swept rearwardly in order to facilitate deflection of any floating or partially submerged impediments to its path as the boat to which the outboard motor has been attached moves through the water. Outboard motors are generally capable of pivoting upwardly about a horizontal axis provided well above the surface of the water in the event that the skeg 10*b* of the housing contacts a stationary object below the surface of the water. It will be apparent that this downward and rearward sweep of the depending skeg 10*b* will very likely discourage at least to some extent the mounting of a propeller guard as suggested in Zoellner.

In spite of the existence of such a skeg configuration the rotating propeller 12 can nevertheless cause considerable damage to marine life, particularly to the manatee which swims just below the surface of the water in the southern United States, particularly Florida.

As best shown in FIG. 2 the propeller guard of the present invention comprises a shallow U-shaped wing-like attachment for the skeg 10*b* of the outboard motor housing 10. Left and right-hand wing-like projections, 16*a* and 16*b* respectively, extend outwardly from the skeg 10*b* and bracket means in the form of left and right-hand L-shaped members 18*a* and 18*b* are provided to secure the left and right wing-like projections to the skeg 10*b*. In its presently preferred form these left and right wing-like projections are integrally fabricated or molded from a thermoplastic material, and the bracket means in the form of left and right L-shaped members comprise separate members although they too may be fabricated from a plastic material. The skeg 10*b* of a typical outboard motor is generally fabricated from a metal such as aluminum.

The wing-like projections 16*a* and 16*b* define a horizontal center wing segment 16*i* which center segment 16*i* is severely swept at the leading edge in order to locate the outermost portions 16*e* and 16*f* of the wing-like projections 16*a* and 16*b* respectively in the plane of rotation of the propeller 12*a*, and to provide a deflecting effect upon the guard striking a floating or submerged object as the boat and its motor proceed along a particular course on the water.

The upturned wing outer wing segments 16*e*, 16*f*; being less severely swept then 16*i*, have concave leading edges, as shown in FIG. 1. The bracket means, more particularly the L-shaped bracket members 18*a*, 18*b* have leg portions which are themselves swept. This bracket configuration assists in locating the outermost panels of the wing-like projections in the plane of rotation of the propeller.

The outboard segments 16*e* and 16*f* for the propeller guard are also swept but not as severely as the center segment 16*i*, and these outer panels or segments of the wing-like projections are also turned upwardly, that is have a positive dihedral, so as to afford a generally semi-circular wing configuration provided in the plane of the rotating propeller.

The leading edge of the both the center wing segment and the outer panels or segments are rounded, and purposefully made without a sharp edge, to protect marine life, and to afford a smooth flow of water into the rotating propeller, thereby preventing propeller cavitations.

The preferred material from which the wing portions of the propeller guard are fabricated is a thermoplastic adapted to flex on impact and to absorb energy. Furthermore, the flexing will be followed by a resilient return of the wing after impact to the original shape and configuration. It is noted that where propeller guards are fabricated from a metal material the guards tend to remain bent and not return to their original after striking objects floating on or under the water. The plastic material absorbs energy without breaking whereas the use of metal can lead to deformation and even breaking by striking underwater obstacles.

An important feature of the present invention is in the configuration for the bracket means. The typical skeg will be swept downwardly and rearwardly as mentioned previously at least along its leading edge, and this feature is conveniently accommodated with a guard of the present invention, and particularly by the bracket means in that the leading edge of the bracket means is swept to correspond with the sweep downwardly and rearwardly of the leading edge of the skeg. Furthermore, the horizontally extending flange of the brackets 18*a*, 18*b* are also swept to conform to the severely swept configuration of the leading edge of the center segment of the wing projections of the present invention. The severe sweep also reduces the impact of or tendency for the guard to strike or catch underwater obstacles.

It is an important feature of the present invention that the swept outer wing panels or segments are provided in the plane of rotation of the propeller. Unlike Zoellner were the wing is provided forward of the propeller and Montague were the upswept wing tip portions are provided rearwardly of the plane of rotation of the propeller the present invention locates these swept wing outer panel segments in the plane of the rotating propeller. Additional distinctions between the present invention and the prior art can be attributed to the preferred three piece construction where the bracket means comprises L-shaped members with swept leading edges, and where the wing portion which is secured by these brackets to the skeg of the outboard motor is preferably fabricated from a thermoplastic material that is relatively strong but resilient and flexible enough to return to its original shape after striking a foreign object floating on or swimming close to the surface of the water.

I have found that the mounting brackets disclosed may be used on many different size motor skeg configurations. These brackets are useable with several different sizes and shapes of wing portions so as to assure that the outboard segments thereof are provided in the plane of rotation of the propeller. Another advantage to the present invention can be attributed to the fact that the wing-like center and outboard panels or sections are provided on the skeg such that the chordwise direction for these wing segments remains parallel to the axis of rotation of the propeller itself. Such is not the case in Zoellner for example where the crescent shaped wing is provided with a positive angle of attack leading to excessive drag cavitation and consequent reduction in speed of a boat equipped with such a device.

The bracket means as shown requires only three or four screws for attaching a device of the present invention to the outboard motor skeg. Eight screws are illustrated for securing the wing portion to the horizontally extending flanges of the bracket means. This number could be reduced, at least in lower horse power smaller outboard motor installations.

The trailing edge of the wing portion of the propeller guard shown is preferably swept slightly to provide a generally concave trailing edge configuration. This geometry has been found useful in preventing cavitation of the propeller without sacrifice to providing the desired degree of protection for the propeller even when the boat in which the outboard motor is mounted is operating in reverse rather than in a forward direction. Thus, the unique propeller guard described and claimed herein has a wing panel with a severely swept leading edge that provides upturned outer wing segments that are located in the plane of rotation of the propeller itself.

I claim:

1. In combination with an outboard motor or the out drive of an inboard/outboard motor wherein said motor has a generally vertically oriented housing supporting a propeller on a generally horizontally oriented axis of rotation, and wherein the housing further includes a depending skeg provided in a vertical plane below and forward of the propeller, which skeg has a downwardly and rearwardly inclined leading edge, the improvement comprising a propeller guard arranged below the rotating propeller, said guard including left and right wing-like projections extending outwardly from the skeg, said left and right wing-like projections having a center wing segment oriented generally horizontally, which horizontal center wing segment has a severely swept leading edge, said left and right wing-like projections having upturned outer wing segments that cooperate with said wing center segment to define a generally U-shaped wing panel provided generally circumaxially of the lower portion of the rotating propeller, said upturned wing outer wing segments being less severely swept providing concave leading edges thereof, which concave leading edges are rounded so as to be deflected by any foreign object coming in contact therewith, said center and outer wing segments being fabricated from a thermoplastic material of flexible and resilient characteristics so as to assure that following any such deflection the wing-like projections tend to assume their original shape, and bracket means comprising two L-shaped members, each L-shaped member having a first flange abutting said skeg and secured thereto, and said bracket means further including second flanges secured to said center wing segment.

2. The combination according to claim 1 wherein the leading edge of each said first flange abutting said skeg is swept to conform generally to the downwardly and rearwardly swept skeg itself.

3. The combination according to claim 2 wherein said second flanges secured to said center wing segment are shorter than said first flanges, and said second flanges being also swept to conform generally to the severely swept leading edge of the center wing segment.

4. The combination according to claim 1 wherein said L-shaped members are secured to said skeg and to said wing center segment by screw fasteners, and wherein said wing panel comprises a unitary thermoplastic molded material having an appropriate size and geometry to match a particular outboard motor and propeller configuration, said wing panel being selected from a group of differently sized wing panels associated with differently sized outboard motor and propeller combinations.

* * * * *